United States Patent [19]

Stedman

[11] 4,059,163

[45] Nov. 22, 1977

[54] MINE DRILLING APPARATUS AND METHOD

[75] Inventor: Robert N. Stedman, Chillicothe, Ill.

[73] Assignee: Caterpillar Tractor Co., Peoria, Ill.

[21] Appl. No.: 714,423

[22] Filed: Aug. 16, 1976

[51] Int. Cl.[2] ..... E21C 25/58

[52] U.S. Cl. ..... 175/73; 173/152; 175/61; 175/62; 175/88; 175/91; 299/18; 299/56

[58] Field of Search ..... 299/18, 55, 56; 175/61, 175/62, 91, 122, 88, 73–76; 173/152, 159

[56] References Cited

U.S. PATENT DOCUMENTS

| | | | |
|---|---|---|---|
| 2,294,318 | 8/1942 | Rich | 175/91 |
| 2,624,548 | 1/1953 | Cochrane et al. | 175/91 |
| 2,764,397 | 9/1956 | Compton | 175/88 X |
| 3,132,701 | 5/1964 | Juntunen | 175/171 X |
| 3,682,261 | 8/1972 | Bird | 175/122 |
| 3,767,836 | 10/1973 | Geis et al. | 175/62 X |
| 3,856,093 | 12/1974 | Case | 173/152 |
| 3,910,358 | 10/1975 | Martinek | 173/152 |

*Primary Examiner*—Ernest R. Purser
*Attorney, Agent, or Firm*—Phillips, Moore, Weissenberger, Lempio & Majestic

[57] ABSTRACT

A drilling apparatus comprises a support structure adapted to be moved on rails to position a drilling assembly mounted thereon adjacent to a selected drilling site. The drilling assembly includes a carriage movably mounted on the support structure for longitudinal movements thereon and a shroud secured on the carriage and having an auger rotatably mounted therein. A cutting edge, having a square configuration, is disposed adjacent to a forward end of the auger and at least one double-acting hydraulic cylinder is interconnected between the support structure and the carriage to aid in pushing the auger and cutting edge through material to form an opening having a square cross section. Upon full extension of the auger and cutting edge, a second drilling assembly may be attached rearwardly on the first-mentioned drilling assembly to increase the overall penetration capabilities of the drilling apparatus.

23 Claims, 9 Drawing Figures

10
14
15
16
17
18
19
20
21
22
23
24
25
26
27
32
35
36
38
41
42
43
44
45
46
47
48
49
50
51
52
53
55
56
X
III
IV
V
VI
VIII

MINE DRILLING APPARATUS AND METHOD

BACKGROUND OF THE INVENTION

Many types of mining equipment have been proposed for mining coal and other minerals economically and expeditiously. The coal is normally cut-out of a solid vein and dropped on a conveyor to load the coal in a shuttle car or the like for transport to a remote location for processing. One type of such mining equipment has cutters mounted on rotating arms which are, in turn, mounted on a mobile vehicle which must be steered to place the cutters in position for cutting purposes.

Another type of mining equipment comprises a horizontally disposed auger adapted to remove soft coal in lumps with minimum fine breakage. The cuttings are carried backwardly by the auger flights to a conveyor belt or the like for loading purposes. The auger is used for mining coal from the edges of strip pits with the standard practice being to cut parallel holes, thus leaving thin pillars or ribs between the holes to support the overburden. Alternatively, a single hole may be cut from a centerline tunnel and the coal from each side thereof being thereafter drilled and blasted into it for recovery purposes.

One of the problems with such drilling equipment is the inability to recover a maximum amount of coal due to the cylindrical bores which are formed thereby. In addition, when the drill is lengthened up to 200 feet, for example, the auger will tend to "wander" and thus cause binding and related problems. Also, the auger itself is not always capable of penetrating obstructions, such as a hard rock seam or a bolder, and thus requires exotic tips on the auger or dynamiting to complete the coal recovery operation.

SUMMARY OF THIS INVENTION

An object of this invention is to overcome the above, briefly described problems by providing an improved drilling apparatus and method for recovering coal and like materials expeditiously and economically. The drilling apparatus comprises a support adapted to be moved transversely along rails and a drilling assembly has a carriage mounted on the support for longitudinal movements thereon. The drilling assembly comprises a rotatable auger, first motor means for selectively rotating the auger and a cutting edge disposed adjacent to the forward end of the auger to cooperate therewith for drilling purposes. A second motor means is interconnected between the support and the carriage for selectively moving the drilling assembly longitudinally on the support to urge the auger bit and cutting edge into cutting engagement with a coal vein, for example.

The cutting edge is preferably rectangular and is at least substantially disposed in a plane perpendicular relative to the longitudinal axis of the auger to form a drill hole having a rectangular and preferably square cross section. Formation of such a square cross section substantially increases the amount of coal which may be recovered in comparison to holes of circular cross section formed by conventional drilling apparatus and methods. In addition, alignment means are preferably adjustably mounted on a forward end of the drilling assembly to stabilize the same and to insure that the auger does not wander to thus form a straight-line hole to avoid binding and related problems. A plurality of the auger assemblies may be attached together in tandem to substantially increase the penetration capabilities of the drilling apparatus.

BRIEF DESCRIPTION OF THE DRAWINGS

Other objects of this invention will become apparent from the following description and accompanying drawings wherein.

DETAILED DESCRIPTION

Figure 1:
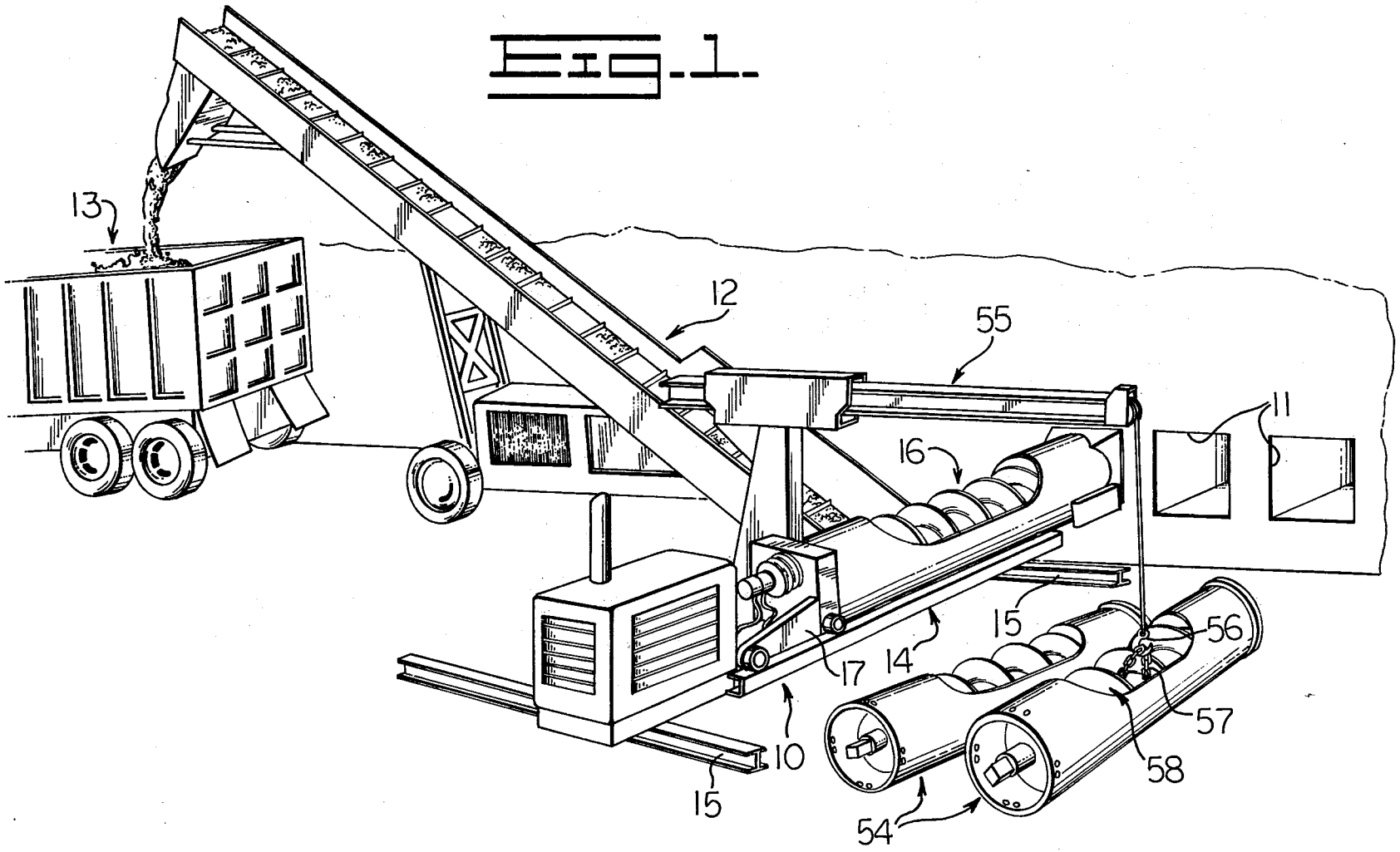
FIG. 1 is an overview of the drilling apparatus of this invention, shown in use during a mining operation.

FIG. 1 illustrates a drilling apparatus 10, embodying this invention, shown in use during a mining operation. In particular, the drilling apparatus is adapted to form holes 11 during the mining of coal or the like. The recovered coal is then deposited on a continuous conveyor 12 which dumps the coal into a truck 13 or the like for transport to a remote location.

Figure 2:
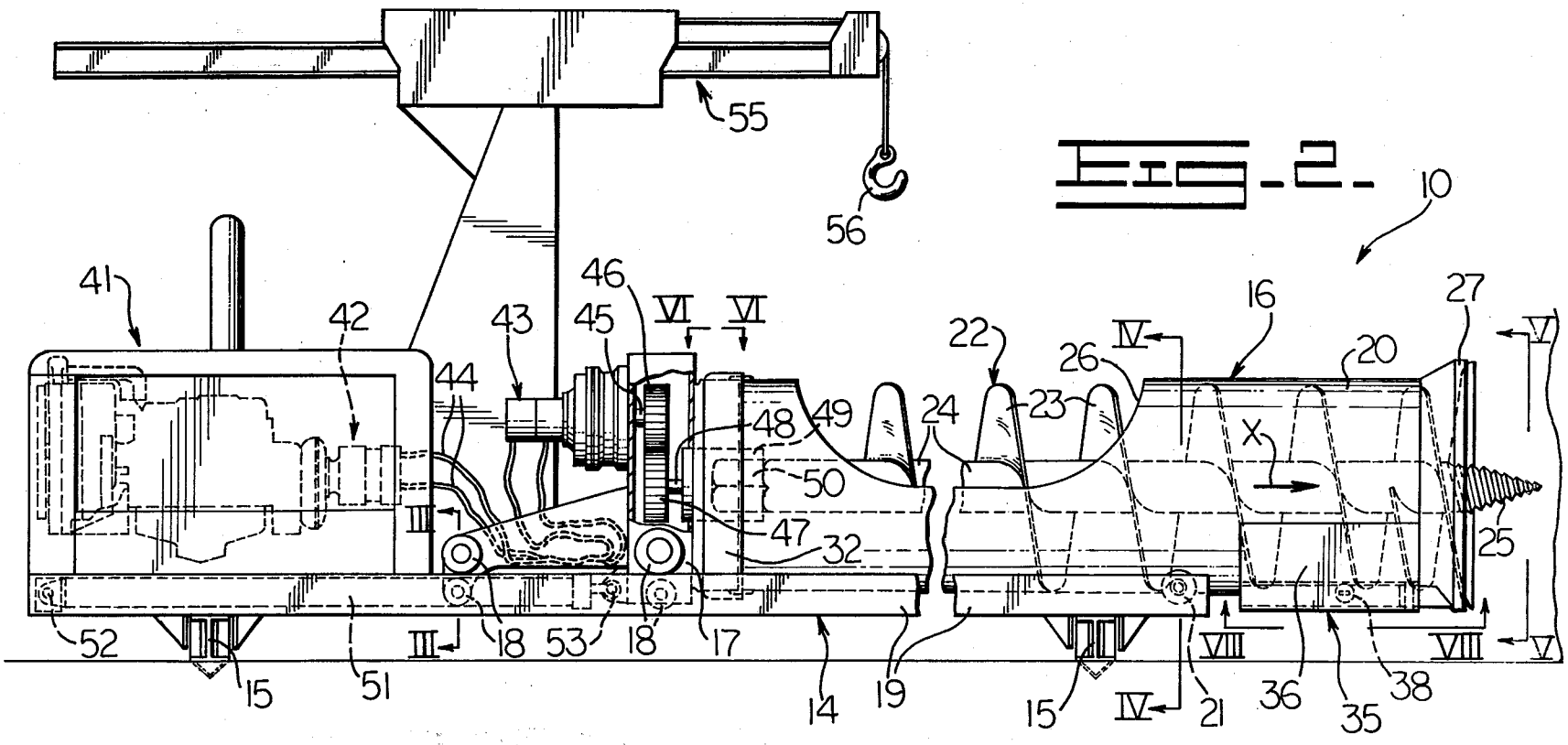
FIG. 2 is an enlarged side elevational view of the drilling apparatus.
Figure 3:
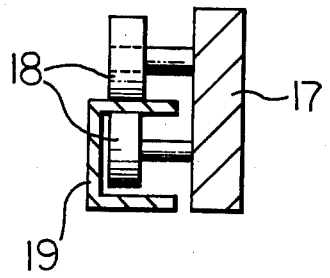
FIGS. 3–6 are views taken in the direction of arrows III—III, IV—IV, V—V and VI—VI, respectively, in FIG. 2.

Referring to FIG. 2, drilling apparatus 10 comprises a support structure 14 mounted on a pair of transversely disposed and laterally spaced rails 15 for movement thereon in a conventional manner. An auger assembly 16 comprises a carriage and frame structure 17 movably mounted on support 14 for longitudinal movements in the direction of an axis X thereon. As shown in FIG. 3, carriage 17 may have two sets of rollers 18 rotatably mounted on each side thereof to engage a rail 19 of support 14 in a conventional manner. The rail thus traps the rollers on either side thereof to permit auger assembly 16 to be moved forwardly of support 14 in cantilevered relationship thereon.

Figure 4:
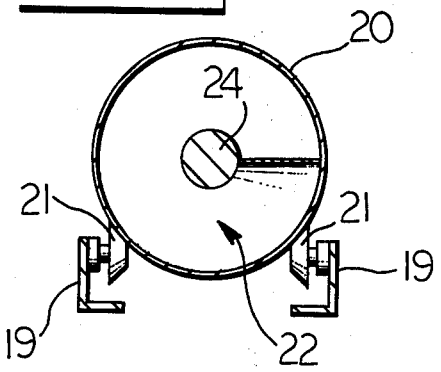

As shown in FIGS. 2 and 4, the auger assembly further comprises a tubular and generally cylindrical shroud 20 having its rearward end secured to carriage 17 for simultaneous movement therewith. At least one roller 21 is rotatably mounted on an inboard side of a forward end of a respective rail 19 of support 14. Each roller is frustoconically shaped to engage the periphery of the shroud in line contact to aid in its extension during a drilling operation.

An auger 22 has a plurality of spiralled flights 23 secured on a shank 24 thereof. A replaceable drill bit 25 is attached to a forward end of shank 24 to initiate a particular drilling operation. A crescent-shaped opening 26 is formed at a rearward end of shroud 20 to permit the egress of boiled drilled materials therethrough and onto conveyor 12 (FIG. 1).

Figure 5:
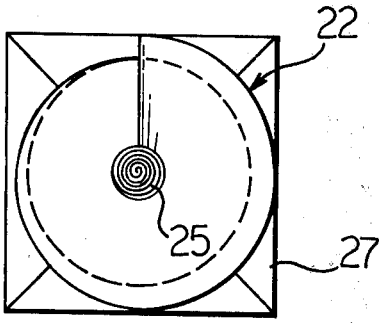

A cutting edge 27 is detachably secured on a forward end of shroud 20 by means, not shown, to circumvent the forward end of auger 22, as illustrated in FIGS. 2 and 5. The cutting edge is rectangular in cross section, preferably square, and is at least substantially disposed in a plane perpendicular relative to the longitudinal axis of the auger. The outside diameter of the auger is slightly less than the height and width of the cutting edge to prevent binding therebetween.

Figure 6:
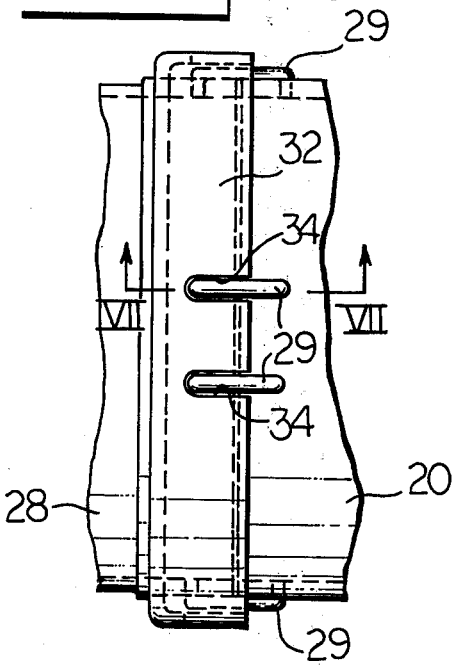
Figure 7:
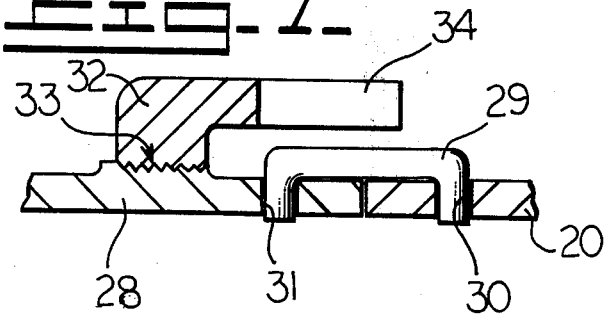
FIG. 7 is a sectional view taken in the direction of arrows VII—VII in FIG. 6.

As shown in FIGS. 2, 6 and 7, a rearward end of shroud 20 is connected to a tubular extension 28 of carriage 17 by a plurality of circumferentially disposed U-shaped fasteners 29. The longitudinal spaced legs of each fastener engage within openings 30 and 31, formed through a sidewall of shroud 20 and through extension 28 of the carriage, respectively. An annular collar 32 is threadably mounted on extension 28 at interengaging screw threads 33 and has a plurality of longitudinally disposed slots 34 formed therethrough. As shown in FIG. 6, upon attachment of shroud 20 to extension 28 of the carriage, each slot 34 is aligned with a respective pair of openings 30 and 31 to permit fastener 29 to be dropped therein. Upon installation of the fasteners, collar 32 is rotated to misalign the slots relative to the fasteners to prevent removal thereof.

Figure 8:
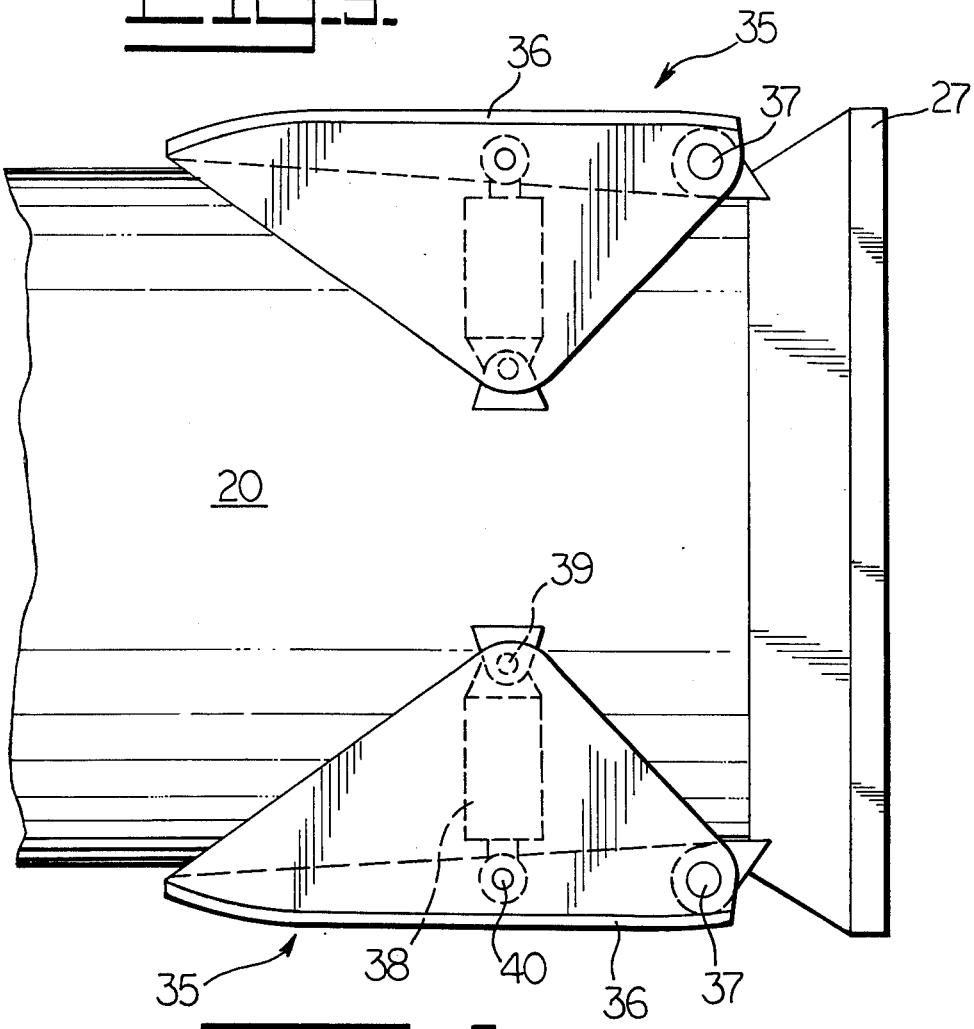
FIG. 8 is an enlarged bottom plan view of a forward portion of the drilling apparatus, taken in the direction of arrows VIII—VIII in FIG. 2.

FIGS. 2 and 8 illustrate a pair of adjustable guide and alignment means 35 mounted on a forward end of shroud 20 to aid in stabilizing and guiding the auger assembly during a drilling operation. Each guide means comprises a slipper 36 in the form of a lever pivotally mounted on the shroud by a pivot pin 37 and substantially disposed in longitudinal alignment with cutting edge 27. A double acting hydraulic cylinder 38 is pivotally interconnected between the shroud and slipper by pivot pins 39 and 40, respectively. Thus, the cylinders may be selectively extended and retracted during a drilling operation to engage sidewalls defining a drilled hole to aid in forming a straight hole, by conventional hydraulic control means (not shown).

The means for rotating auger 22 and for moving the auger assembly in the direction of axis X (FIG. 2) for earth penetration purposes will now be described. An internal combustion engine 41, such as a diesel, is mounted rearwardly on support structure 14 and is adapted to actuate a hydraulic pump 42. The pump is operatively connected in a conventional manner to a hydraulic slave motor 43 by flexible lines 44 for driving an output shaft 45.

The output shaft is secured to a first spur gear 46 which meshes with a second spur gear 47 to selectively impart rotation thereto by operator control means, not shown. The second spur gear is secured to a countershaft 48 which has a square socket 49 secured thereto for rotation therewith. The female socket is adapted to receive a like-shaped male drive lug 50 to form a releasable coupling normally held in engagement by members 29 (FIGS. 6 and 7).

Thus, it can be seen that selective actuation of motor 43 will rotate auger 22 under the control of the operator. The motor is preferably reversible and is mounted on carriage 17 along with its attendant drive mechanisms for forward movement in the direction of axis X (FIG. 2) during an earth penetrating operation. A second motor means, preferably in the form of one or more double-acting hydraulic cylinders 51, preferably of the telescopic type, is pivotally interconnected between support 14 and carriage 17 by pivot pins 52 and 53, respectively.

The cylinder is suitably integrated in the overall hydraulic control system and is adapted to be extended and retracted by the operator by conventional control means (not shown) which coordinate with the control means for actuating motor 43 to effect the earth drilling function. In particular, extension of cylinder 51 will function to move carriage 17 forwardly to engage drill bit 25 and cutting edge 27 with the earth or a coal vein, for example, to form the square shaped cut-outs illustrated in FIG. 1. Cylinders 38 (FIGS. 2 and 8) may be selectively extended and retracted to aid in maintaining auger assembly 16 in proper alignment.

Referring to FIGS. 1, 2, 6, 7 and 9, upon maximum forward extension of the auger assembly on support 14, collar 32 may be rotated to expose fasteners 29 to permit their release from their respective mounting holes 30 and 31. Upon such release, cylinder 51 can be retracted to its FIG. 2 position whereby an auger extension assembly 54 can be mounted on support 14 between the rearward end of auger assembly 16 and the forward end of carriage 17.

Figure 9:
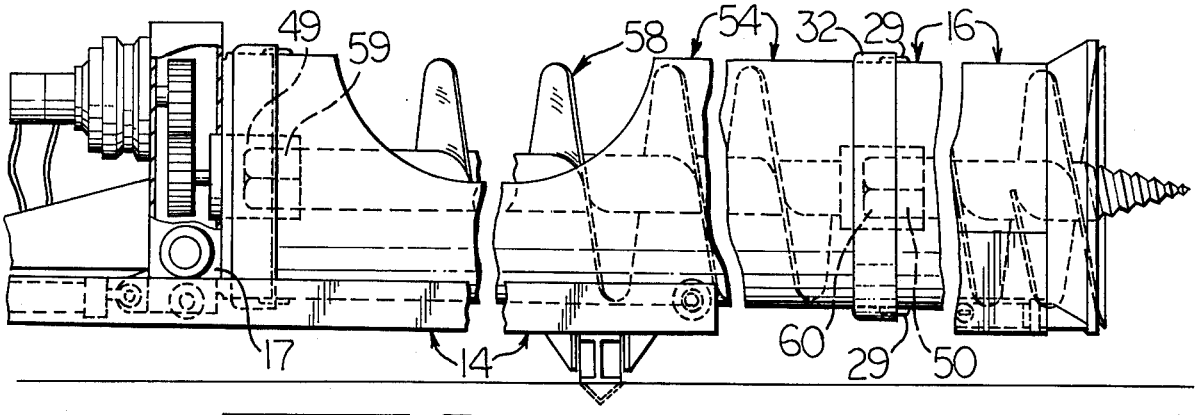
FIG. 9 is a partial view similar to FIG. 2, but illustrating the capability of attaching a plurality of drilling assemblies of the drilling apparatus in tandem to increase the depth of penetration thereof during a mining operation.

As shown in FIGS. 1 and 2, a crane 55 may be employed to engage a hook 56 thereof under a chain 57 wrapped around a shaft of an auger extension 58. As shown in FIG. 9, the auger extension may be lifted and placed in axial alignment with the longitudinal axis of auger 22 whereby a male drive lug 59 secured on a rearward end of the shaft of auger 58 may engage socket 49.

The forward end of the shaft for auger extension 58 has a socket 60 secured on the forward end thereof to receive male drive lug 50 of auger assembly 16. Upon full forward extension and penetration of tandemly arranged auger assembly 16 and auger extension assembly 54, a second such auger extension assembly 54 may be connected in tandem to the first mentioned auger extension assembly and carriage 17 to further increase the overall penetration capabilities of the drilling apparatus.

What is claimed is:

1. A drilling apparatus comprising a support, an auger assembly including a carriage mounted on said support for longitudinal movements thereon, a rotatable auger, first motor means for selectively rotating said auger, a cutting edge disposed adjacent to a forward end of said auger to cooperate therewith for drilling purposes, a tubular shroud disposed around said auger, a plurality of circumferentially disposed fastening means releasably connecting a rearward end of said shroud to said carriage and an annular collar means adjustably mounted on said carriage for movement between a first position for permitting removal of said fastening means and a second position for preventing removal of said fastening means, and second motor means interconnected between said support and the carriage of said drilling assembly for selectively moving said drilling assembly longitudinally on said support.

2. The drilling apparatus of claim 1 wherein said support is mounted for movement on a plurality of spaced rails disposed transversely relative thereto.

3. The drilling apparatus of claim 2 wherein said support comprises a pair of laterally spaced rails and wherein said carriage has a plurality of rollers rotatably mounted thereon and engaging said rails for guiding longitudinal movements of said auger assembly on said support.

4. The drilling apparatus of claim 3 wherein said rollers comprise at least one pair of rollers rotatably mounted on each side of said carriage and engaged on either side of a respective one of said rails.

5. The drilling apparatus of claim 4 wherein two pairs of said rollers are mounted on each side of said carriage and are spaced longitudinally thereon.

6. The drilling apparatus of claim 1 wherein said shroud has an opening formed therein adjacent to a rearward end thereof adapted to permit the egress of material therethrough for loading purposes.

7. The drilling apparatus of claim 1 wherein said support has at least one roller rotatably mounted on a forward end thereof to engage a bottom portion of said shroud to guide said shroud during longitudinal movements of said auger assembly.

8. The drilling apparatus of claim 7 wherein said roller has a frustoconical shape and engages said shroud in line contact, said shroud being generally cylindrical in shape.

9. The drilling apparatus of claim 1 wherein said cutting edge is secured on a forward end of said shroud.

10. The drilling apparatus of claim 9 wherein said cutting edge is rectangular and is at least substantially disposed in a plane perpendicular relative to a longitudinal axis of said auger.

11. The drilling apparatus of claim 10 wherein said cutting edge is square and is sized to substantially correspond to an outside diameter of said auger.

12. The drilling apparatus of claim 1 wherein each of said fastening means comprises a U-shaped fastener having a pair of legs with each leg thereof disposed in an opening formed in each of said shroud and said carriage.

13. The drilling apparatus of claim 1 wherein said collar means has a plurality of longitudinally disposed slots formed therethrough to normally overlie each of said fastening means whereby rotation of said collar on said carriage will misalign said slots relative to said fasteners to prevent removal of said fasteners.

14. The drilling apparatus of claim 1 further comprising alignment means adjustably mounted on a forward end of said shroud for movements radially outwardly relative thereto to aid in maintaining said auger assembly in alignment within a drilled hole formed thereby.

15. The drilling apparatus of claim 14 wherein said alignment means comprises a pair of slippers movably mounted on opposite sides of said shroud.

16. The drilling apparatus of claim 15 wherein each of said slippers comprises a plate member normally substantially longitudinally aligned with respect to said cutting edge.

17. The drilling apparatus of claim 15 wherein each of said slippers is pivotally mounted adjacent to a forward end of said shroud and further comprising actuating means pivotally interconnected between each of said slippers and said shroud to selectively pivot the slippers on the shroud. selectively pivot the slippers on the shroud.

18. The drilling apparatus of claim 17 wherein each of said actuation means constitutes a double-acting hydraulic cylinder.

19. The drilling apparatus of claim 1 further comprising gear means connecting an output shaft of said first motor means to said auger for selectively rotating said auger.

20. The drilling apparatus of claim 19 further comprising means releasably coupling a rearward end of said auger to an output shaft of said gear means.

21. The drilling apparatus of claim 20 wherein said coupling means comprises a socket secured to the output shaft of said gear means and a drive lug normally inserted within said socket for simultaneous rotation therewith.

22. The drilling apparatus of claim 1 further comprising an internal combustion engine mounted on a rearward end of said support, a hydraulic pump mounted on said engine to be driven by said engine and wherein said first motor means constitutes a hydraulic motor connected to said pump to be driven thereby.

23. The drilling apparatus of claim 1 wherein said second motor means comprises at least one double-acting hydraulic cylinder interconnected between said support and said carriage for selectively moving said auger assembly longitudinally upon selective extension and retraction of said cylinder.

* * * * *